US008092672B2

(12) United States Patent
Ganguli et al.

(10) Patent No.: US 8,092,672 B2
(45) Date of Patent: Jan. 10, 2012

(54) METHOD AND APPARATUS FOR HYDROPROCESSING LOW-VOLATILE HYDROCARBON MATERIALS INTO VOLATILE LIQUIDS

(75) Inventors: Partha S. Ganguli, Princeton, NJ (US); Alfred G. Comolli, Yardley, PA (US)

(73) Assignee: Energy Catalysis Incorporated, Bordentown, NJ (US)

( * ) Notice: Subject to any disclaimer, the term of this patent is extended or adjusted under 35 U.S.C. 154(b) by 744 days.

(21) Appl. No.: 12/082,522

(22) Filed: Apr. 11, 2008

(65) Prior Publication Data

US 2008/0251420 A1 Oct. 16, 2008

Related U.S. Application Data

(60) Provisional application No. 60/923,684, filed on Apr. 16, 2007.

(51) Int. Cl.
*C10G 1/06* (2006.01)
*C10G 65/02* (2006.01)

(52) U.S. Cl. ..... 208/57; 208/413; 208/423; 208/59; 208/143

(58) Field of Classification Search ..... 208/57–59, 208/108, 112, 143–145, 419, 421–423, 412, 208/413, 420
See application file for complete search history.

(56) References Cited

U.S. PATENT DOCUMENTS

| | | | | |
|---|---|---|---|---|
| 6,054,043 | A | 4/2000 | Simpson | |
| 2007/0158236 | A1 * | 7/2007 | Zhou et al. | 208/15 |
| 2007/0161505 | A1 * | 7/2007 | Pereira-Almao et al. | 502/216 |

OTHER PUBLICATIONS

Merriam, Norman W. et al; "Design, Testing, and Operation of a Plug-Flow, Inclined Fluidized Bed Reactor"; Western Research Institute; pp. v, 1-28; Sep. 1987.*

* cited by examiner

*Primary Examiner* — Walter D Griffin
*Assistant Examiner* — Renee E Robinson
(74) *Attorney, Agent, or Firm* — Moser Taboada

(57) ABSTRACT

A method and apparatus for catalytic hydroconversion processing of less volatile carbonaceous material to volatile liquid products is disclosed. The process is carried out in a plug-flow reactor system using nanosize metallic catalyst particles dispersed in the reactant slurry with compressed hydrogen/hydrogen-sulfide at a temperature between about 275° C. and 525° C. at a pressure of between about 800 psi and 6000 psi and a residence time in the reactors between about 1 minute and 4 hours.

13 Claims, 1 Drawing Sheet

METHOD AND APPARATUS FOR HYDROPROCESSING LOW-VOLATILE HYDROCARBON MATERIALS INTO VOLATILE LIQUIDS

CROSS-REFERENCE TO RELATED APPLICATIONS

This application claims benefit of U.S. provisional patent application Ser. No. 60/923,684, filed Apr. 16, 2007, which is herein incorporated by reference.

GOVERNMENT RIGHTS IN THIS INVENTION

This invention was made with U.S. government support under contract number DE-FG02-052R84256. The U.S. government has certain rights in this invention.

BACKGROUND OF THE INVENTION

1. Field of the Invention

Embodiments of the present invention generally relate to a method and apparatus for hydroprocessing of hydrocarbon materials into clean volatile liquid products.

2. Description of the Related Art

Most hydroprocessing and other direct liquefaction processes for low-volatile hydrocarbon materials (LVHMat), such as insufficiently hydrogenated carbonaceous materials including as coal, heavy petroleum feedstock, tar-sand oil, shale oil or any process derived carbonaceous products, are based on catalytic hydroconversion of an LVHMat oil slurry in multi-stage ebullated bed reactors using catalyst extrudates or slurry bed reactors using fine dispersed catalysts. Depending upon the feed, LVHMat's properties and operating conditions, less than 70 w % of distillate oils can be recovered.

Because of exothermic reactions in the LVHMat hydroprocess, prior processes typically utilized a bubble-column reactor system. Conventional bubble column, slurry bed and fluid bed reactors currently used for LVHMat hydroprocessing are nearly fully mixed; resulting in moderate conversion since the fresh unreacted feed and fully reacted material both have a good chance of leaving the reactor. Also these reactor systems do not have sufficient turbulence to allow proper mass and heat transfer, resulting in under-reaction or over-reaction for the desired products.

The organic fraction of LVHMat is composed of a wide range of organic compound types, varying both in their molecular configuration and their degree of reactivity. As a result, some of the organic compounds react early in the process, yielding desirable light products, and some compounds react at the later part of the process. Current processes require overall reaction times of 15 to 90 minutes. Unless the reaction products formed in the early part of the process are removed, they start to retrogress. This happens in the form of further cracking r, ultimately to light hydrocarbon gases. Another retrogression route for both the light and the heavy product compounds is through polymerization to refractory high molecular weight aromatics or tars.

To address these problems in LVHMat hydroprocessing and other liquefaction processes, Simpson in U.S. Pat. No. 6,054,043 ("Simpson") disclosed a system including several fluid bed reactors and a single stage plug-flow reactor operating in the turbulent flow region with staged venting of volatile products followed by several fluid bed reactors with optional injection of supplemental hydrogen gas, catalyst, or fresh solvent. Simpson has also disclosed improvements providing an adequate presence of active hydrogen, adequate agitation to overcome mass transfer limitation, and a high rate of heat transfer.

SUMMARY OF THE INVENTION

The present invention generally is a method for hydroprocessing of low-volatile hydrocarbon materials (LVHMat) comprising the steps of adding a catalytic material and hydrogen gas containing hydrogen sulphide to a LVHMat slurry; pumping the mixture of the LVHMat slurry through one or more serially connected plug-flow reactors at a rate sufficient to cause turbulent flow in the reactors which are maintained at temperatures between 250° C. to 500° C. and preferably between about 400° C. and 450° C.; and drawing light hydrocarbon fluids from the reactor effluent. The present invention is also an apparatus for hydroprocessing of low-volatile hydrocarbon materials (LVHMat) comprising a mixing vessel containing a stirred LVHMat slurry connected to a slurry pump; a pump for adding a catalytic material to the pumped LVHMat slurry; an inlet valve for permitting the addition of pressurized hydrogen gas containing hydrogen sulphide to the pumped LVHMat slurry; a pump serially connected between the mixing vessel and an one or more plug-flow reactors for pumping the LVHMat slurry through the plug-flow reactors at a temperature between about 250° C. and 500° C. at a pressure between about 1000 and 6000 psi at a rate sufficient to cause turbulent flow of the LVHMat slurry through the reactors; and a separator serially connected to the output to remove light hydrocarbon fluids from the effluent of the second reactor.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
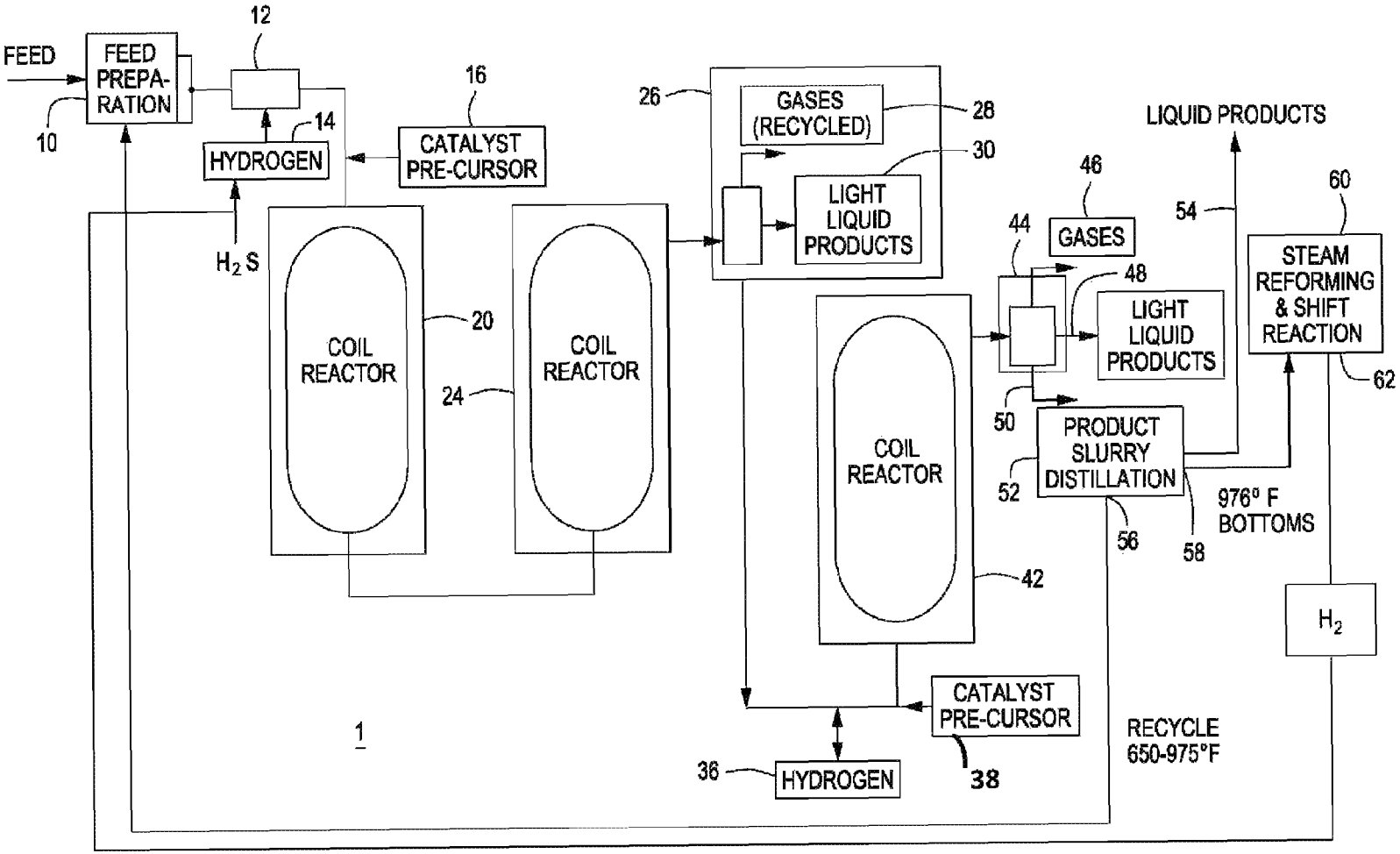
FIG. 1 is a schematic diagram of three-stage hydroconversion process of the invention.

The invention is a process and apparatus for the efficient conversion of LVHMat to volatile liquids using a plug-flow multiple reactor system, the use of highly active nanoscale catalytic metal suspension to produce in-situ activated catalyst for efficient LVHMat hydroconversion, small-diameter coil reactors for LVHMat slurry flow in the turbulent region with high heat and mass transfer for exothermic reactions of hydroconversion to improve product quality and product yield.

In LVHMat hydroprocessing, the input to the reactor is LVHMat slurry. The LVHMat is typically an insufficiently hydrogenated carbonaceous material such as coal, heavy petroleum feedstock, oil from tar sands, shale oil or any process derived carbonaceous product. Coal is typically milled to a powder. The LVHMat is mixed with a heavy oil to create a slurry. The heavy oil product can be obtained from the output of the processing apparatus. A nanoscale catalytic metal suspension, and high-pressure hydrogen gas containing a 0.5-1.0 v % of hydrogen sulfide are added to the pressurized LVHMat slurry. The active metal particles dispersed in the slurry react with hydrogen sulfide to produce metal sulfide and activated hydrogen molecules to participate in hydrocracking reactions of LVHMat hydroprocessing. From a reaction kinetics standpoint it is known that in-situ production of hydrogen at reaction temperatures provides hydrogen in an activated state. Because of the presence of nanoscale metal particles in the slurry and in-situ production of activated hydrogen molecules, mass transfer and reaction kinetics to hydroconversion reactions for LVHMat hydroprocessing are greatly enhanced.

The reactor system comprises at least one, typically two and preferably three plug-flow reactors in series, each reactor comprising a heater sufficient to maintain a coiled tube at the desired reaction temperatures which are at a temperature between about 250° C. and 500° C. and typically between about 400° C. and 450° C. The first input stage is a preheater heated up to a temperature of about 415° C. temperatures to allow mild hydrogenation reactions in the LVHMat-oil slurry. The second intermediate stage is maintained at a temperature between about 426° C. and 432° C. in order to accomplish hydrogenation and mild hydrocracking of the hydrogenated LVHMat product. The third output stage is maintained at a temperature between about 432° C. and 450° C. to complete all possible hydroconversion reactions to light liquid products.

A hydroprocessing system 1 of the invention is shown in FIG. 1. A LVHMat-oil slurry is mixed in vessel 10 and is pumped by pump 12. Hydrogen gas typically containing 0.1 to 5 v % of $H_2S$ is added to the pumped slurry from pressurizer 14. A catalyst precursor is added to the pumped slurry from catalyst source by pump 16. The hydrogen, $H_2S$ and catalyst precursor are added to the slurry at pressures between about 800 psi and 6000 psi and preferably greater than 1500 psi and generally at a pressure of about 2500 psi. This mixture is pumped into the first input reactor 20 which acts as a preheater and is heated to a temperature of about 415° C. The flow rate and tube diameter of reactor 20 are such that the flow in reactor 20 is turbulent. The residence time in reactor 20 is typically between about 1 and 5 minutes.

The output of reactor 20 is serially coupled to the input of intermediate reactor 24 such that the effluent of reactor 20 flows under pressure into reactor 24. This flow in reactor 24 is typically maintained at a pressure between about 800 psi and 6000 psi and preferably between about 2000 psi and 3000 psi, at a at a temperature between about 400° C. and 450° C. and typically at a temperature between about 426° C. and 432° C. for a residence time typically between about 0.1 and 20 minutes in reactor 24. The output of the intermediate reactor 24 is vented into hot separator 26 which separates gases 28 and light liquids 30 in the effluent as overhead product from the output LVHMat slurry. Alternatively, hot separator 20 may not be present.

The output 32 of intermediate reactor 24 is serially coupled either to hot separator 26 for the removal of light gases or directly to the input of output reactor 42 if the hot separator is not present. Pressurized hydrogen gas is added to the flowing slurry from pressurized hydrogen source 36. A catalyst precursor added to the slurry by pump 38. Reactor 42, similar in design to reactor 24, is maintained at a temperature between about 400° C. and 450° C. and typically at a temperature between about 432° C. and 450° C. at a pressure between about 1000 psi and 3000 psi and preferably at a pressure between about 1500 psi and 2500 psi for a residence time typically between about 1 and 20 minutes. Flow in reactor 42 is also in the turbulent flow regime. The output of reactor 42 is coupled to the input of hot separator 44.

Hot separators are well known in the art and typically comprise a heated pressure vessel having a venting system in its top to remove gases including vapors of light liquid products and a bottom valve for the removal of liquid and solid products.

Light gases are removed from separator 44 at output 46. Light distillate products are removed from separator 44 at output 48. Bottom products are removed from separator 44 at output 50.

The bottom product output of separator 44 is serially coupled to the input of distiller 52. Distiller 52 is typically operated at a temperature. Middle distillate products are removed from the distiller 52 at output 54. Remaining heavy oils are removed from distiller 52 at output 56. Remaining heavy bottom products are removed from distiller 52 at output 58 which is serially connected to steam reforming and shift reactions processing apparatus 60.

The heavy oils have a boiling point between about 250° C. and 600° C. and typically between about 350° C. and 500° C. This distilled product which is removed from distiller at output 56 can be reintroduced into the input LVHMat slurry to improve product yield and heavy product conversion.

The remainder heavy bottom product removed is processed in a steam reforming and shift reactions processing apparatus to produce hydrogen at output 62 which can then be recycled back into the process at pressurizer 14.

The light distillate products typically have boiling points between about 90° C. and 200° C. The middle distillate products typically have boiling points between about 200° C. and 350° C. The heavy liquid products typically have boiling points between about 350° C. and 525° C. The heavy bottom products typically have boiling points greater than about 525° C. The middle distillate products are the most desirable products and can be further hydrotreated to meet the specific product criteria such as various blends of gasoline and diesel fuels.

Catalysts include nanosize metal particles composed of one to multiple catalytically active metals from the transition metal group as well as the precious metal group in the periodic table; preferable transition metals are Fe, Co, Mo, Ni, W, Sn and preferable precious metals are Pd, Pt, and Rh. Transition metals are catalytically active in sulfided form. A single nanoparticle may be composed of bimetallic or trimetallic mixtures of these metals such as Fe/Mo, Fe/Ni, and Fe/Mo/Ni systems to achieve high synergistic catalytic activities but mixtures having more that three constituents are also useful. In a bimetallic or trimetallic catalyst, the particles typically have one metal, such as Fe, in combination with at least 0.5 wt %, and preferably at least 1 wt % of other metals. The surface area of a Fe/Mo/Ni nano-catalyst sample is 101.7 m2/gm.

Metallic nanoparticles are prepared by specific reduction of compounds of the specific metals. These metals in nanoscale sized particles can be produced on a large scale by various methods in the gas phase (see W. E. Pratsinis, Powder Technology, 88, 1996, 267 and M. T. Swihart, Colloid and Interface Science, 8, 2003, 127-133) or in the liquid phase (see Chen, D. H., et al., J. Mater. Chem. 12(8), 2002, 2412-2415 and Zhang, W. C., et al., Catal. Today 40(4), 387-395), and stored as a suspension in oil such as tetralin, a hydrocarbon having the chemical formula $C_{10}H_{12}$. Bimetallic nanoparticles (see Doker, O., et al., Rev. Adv. Mater. Sci. 5, 2003, 498-500) such as Fe/Ni or Fe/Mo can be produced using a reverse micellar system. These nanoscale metal particles are in the size range of 20 nm to 200 nm. Because of their small size and numerous active edges, these nanoscale particles have surface area in the 40 to 200 $m^2$/gm range and are highly active compared to large size (>500 nm) particles. In slurry, these nanoscale metal particles behave as a homogenous medium, thereby enhancing mass transfer operations.

Nanoscale sized particles of an iron catalyst were prepared by reduction of an iron compound $FeCl_3$ using sodium borohydride as a reductant in an aqueous medium (see Zhang, W., J. Nanoparticle Research, 5, 2003, 323-332 and Kanel, R. K., et al., Env. Sci. Tech., 39, 2005, 1291-1298). The Fe/Mo nano-particles were prepared by stirring the iron particles in an aqueous solution of ammonium heptamolybdate. Fe/Ni particles were similarly prepared by stirring iron particles in an aqueous solution of nickel chloride.

It is known that the sulfide forms of these metal particles are the active catalysts for hydroconversion reactions in LVHMat hydroprocessing. So the above reaction Fe+H2S→H2+FeS is producing active catalyst that participates in hydrogenation reactions using dissolved hydrogen as well as activated hydrogen. The catalytic hydrodesulphurization of LVHMat also produces $H_2S$ which in turn reacts with nanoscale metal particles forming active catalyst and active hydrogen.

Nanoscale iron catalyst particles were prepared by using sodium borohydride as the key reductant. For example, $NaBH_4$ (1.0 M) was added into $FeCl_3.6H_2O$ (0.25 M) solution (1:1 volume ratio) with constant stirring at room temperature. Ferric iron reduced by the borohydride according to the following reaction:

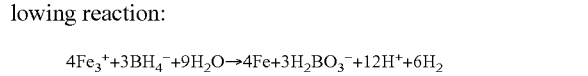

$$4Fe_3^{+}+3BH_4^{-}+9H_2O \rightarrow 4Fe+3H_2BO_3^{-}+12H^{+}+6H_2$$

The resulting slurry was then centrifuged for 2 minutes to separate the nanoscale iron particles from the aqueous medium. The particles were stored in an organic medium such as acetone, tetralin or decalin.

Fe/Mo or Fe/Ni particles were prepared by stirring the freshly prepared nanoscale iron particles with an aqueous solution of 5 w % ammonium heptamolybdate or 5 w % nickel chloride for 30 minutes at room temperature. This caused the reduction of Mo or Ni compounds by iron and subsequent deposition of Mo or Ni on the Fe surface.

SEM/EDX analyses were conducted on a Fe/Mo slurry sample. At 20,000× the image suggests that the long "fibril" consists of nanoscale particles. The overall elemental profile of the particles shows Fe and Mo. These particles are composed of 2.7 w % molybdenum and 97.3 w % iron. In particular, the composition of a Fe/Mo/Ni nano-catalyst consists of 66.3 w % Fe, 28.3 w % Mo, and 5.4 w % Ni. Nanoparticles used here typically have dimensions between about 10 and 500 nanometers dimensions and preferably in the range between about 10 and 100 nanometers.

LVHMat hydroprocessing experimental runs at temperatures between about 400° C. and 450° C. using Illinois #6 bituminous coal, 5000 ppm Fe or Fe/Mo catalyst particle concentration, 2 v % $H_2S$ in hydrogen at 2500 psi pressure and 2 to 5 minute residence time in each reactor resulted in the following product yields and conversions. Typically the catalyst is present in the slurry in a concentration of about 0.1 wt % with respect to the LVHMat feed.

Normalized Yields, W % MAF LVHMat

| Catalyst | Fe/Mo | Fe |
|---|---|---|
| $C_1$-$C_3$ in Gases | 3.8 | 4.3 |
| $C_4$-204° C. in Liquids | 40.9 | 34.6 |
| 204° C.-524° C. in Liquids | 38.1 | 42.9 |
| 524° C.$^+$ | 8.0 | 9.2 |
| Water, $CO_x$, $H_2S$, $NH_3$ | 14.1 | 13.8 |
| Total (100 + $H_2$ reacted) | 104.9 | 104.8 |

-continued

Normalized Yields, W % MAF LVHMat

| Catalyst | Fe/Mo | Fe |
|---|---|---|
| LVHMat Conversion, w % MAF LVHMat | 95.5 | 93.8 |
| $C_4$-524° C. Distillate Yield | 79.0 | 77.5 |

These results indicate that bimetallic Fe/Mo catalysts are superior to metallic Fe catalyst particles. The liquid products were quite clean. For example, the 400° C. =524° C. liquid product has the following elemental analysis: 88.8 w % carbon, 11.1 w % hydrogen, 0.14 w % sulfur and <0.5 w % (detection limit) nitrogen.

The plug-flow reactors used in these tests were in the form of coils about 122 meters long having an inside diameter about 0.64 cm. Commercial embodiments of the invention will likely have different sized reactors to enable increased throughput.

The Reynolds number is determined from:

$$R=D*V_m*L/M=V_m*L/V$$

Where for a fluid $V_m$ is the mean fluid velocity, L is the characteristic length, M is the dynamic viscosity, V=M/r is the kinematic viscosity and D is the fluid density. For flow in pipes the characteristic length is the pipe diameter if the cross section is circular. Laminar flow occurs at Reynolds numbers below about 2100 while turbulent flow occurs at Reynolds numbers above about 3000.

The inventive method comprises the steps of adding a catalytic material and hydrogen gas containing hydrogen sulphide to a LVHMat slurry; heating the slurry to a temperature between about 400 C and 450 C; pumping the mixture of the catalytic material, hydrogen and LVHMat slurry through multiple plug flow-reactors at a rate sufficient to cause turbulent flow and drawing light hydrocarbon fluids from the reactor. The catalyst is preferable a bimetallic or trimetallic combination where the metals are selected from the group consisting of Fe, Co, Mo, Ni, W, Sn, Pd, Pt, and Rh. The combination is typically composed of one predominant metal, such as Fe, in combination with at least 0.5 wt %, and preferably at least 1 wt % of other metals.

In general, we have disclosed the catalytic hydroconversion processing of less volatile carbonaceous material to volatile liquid products in a multiple-stage plug-flow reactor system using nanosize multi-metallic catalyst particles dispersed in the reactant slurry with compressed hydrogen/hydrogen-sulfide at a temperature between about 275° C. and 525° C. at a pressure of between about 800 psi and 6000 psi pressure and a residence time in the reactors between about 1 minute and 4 hours.

While the foregoing is directed to embodiments of the present invention, other and further embodiments of the invention may be devised without departing from the basic scope thereof, and the scope thereof is determined by the claims that follow.

The invention claimed is:

1. A method for hydroprocessing of low-volatile hydrocarbon materials (LVHMat) comprising the steps of:

adding particles of nanoscale catalytic material to an LVHMat slurry;

adding pressurized hydrogen gas containing hydrogen sulfide to the slurry;

pumping the slurry through heated input and output serially connected plug-flow reactors maintained at a temperature between about 250° C. and 500° C. at a rate sufficient to cause turbulent flow in the reactors, the said plug-flow reactors maintained at serially higher temperatures; and drawing hydrocarbon fluids from the effluent of the output reactor.

2. The method of claim 1 wherein the reactors are maintained at a temperature between about 400° C. and 450° C.

3. The method of claim 2 comprising the step of pumping the slurry through an intermediate plug-flow reactor serially connected between the input and output plug-flow reactors at a rate sufficient to cause turbulent flow in all the reactors and drawing light hydrocarbon fluids from the effluent of the second reactor.

4. The method of claim 3 where the catalyst is a nanoscale bimetallic containing a mixture of two metals each metal in a concentration of at least 0.5 wt %, the catalyst particles being in the size range between about 10 nm and 200 nm and formed by reduction of a salt of one said metal by and upon particles of iron.

5. The method of claim 4 where the metal salts are selected from the group consisting of Co, Mo, Ni, W, Sn, Pd, Pt, and Rh salts.

6. The method of claim 3 where the catalyst is a nanoscale trimetallic containing a mixture of three metals each metal in a concentration of at least 0.5 wt %, the catalyst particles being in the size range between about 10 nm and 200 nm and formed by reduction of salts of said metals by and upon particles of iron.

7. The method of claim 6 where the metal salts are selected from the group consisting of Co, Mo, Ni, W, Sn, Pd, Pt, and Rh salts.

8. The method of claim 3 where the catalyst is a nanoscale multimetallic containing a mixture of at least two metals each metal in a concentration of at least 0.5 wt % s.

9. The method of claim 8 where the metals are selected from the group consisting of Fe, Co, Mo, Ni, W, Sn, Pd, Pt, and Rh.

10. The method of claim 3 wherein the residence times in each of the plug flow reactors is greater than about one minute .

11. A method for hydroprocessing of low-volatile hydrocarbon materials (LVHMat) comprising the steps of:

adding a nanoscale catalytic material to an LVHMat slurry;

adding pressurized hydrogen gas containing hydrogen sulfide to the slurry;

pumping the slurry through a plug-flow reactor at a temperature between about 400° C. and 432° C. at a rate sufficient to cause turbulent flow in the reactor;

subsequently pumping the slurry through another plug-flow reactor at a temperature between about 426° C. and 450° C., the pumping at a rate sufficient to cause turbulent flow in the reactor, the first plug-flow and subsequent plug-flow reactors maintained at serially higher temperatures; and directly drawing light hydrocarbon fluids from the effluent of the subsequent plug-flow reactor.

12. The method of claim 11, wherein a third plug-flow reactor is used sequentially with said first and subsequent plug-flow reactors, wherein one said plug-flow reactor is operated at about 415° C., a said plug-flow reactor immediately subsequent is operated between about 426° C. and 432° C., and a said plug flow reactor immediately subsequent is operated between about 432° C. and 450° C.

13. The method of claim 12 wherein the residence times in each of the plug flow reactors is greater than about one minute .

* * * * *